US007252379B2

(12) United States Patent
Silverbrook

(10) Patent No.: US 7,252,379 B2
(45) Date of Patent: Aug. 7, 2007

(54) MANUALLY MOVEABLE PRINTER WITH SPEED SENSOR

(75) Inventor: Kia Silverbrook, Balmain (AU)

(73) Assignee: Silverbrook Research Pty Ltd, Balmain, NSW (AU)

( * ) Notice: Subject to any disclaimer, the term of this patent is extended or adjusted under 35 U.S.C. 154(b) by 261 days.

(21) Appl. No.: 10/503,886

(22) PCT Filed: Feb. 12, 2003

(86) PCT No.: PCT/AU03/00154

§ 371 (c)(1),
(2), (4) Date: Aug. 9, 2004

(87) PCT Pub. No.: WO03/068515

PCT Pub. Date: Aug. 21, 2003

(65) Prior Publication Data

US 2005/0104914 A1 May 19, 2005

(30) Foreign Application Priority Data

Feb. 13, 2002 (AU) ..... PS0484

(51) Int. Cl.
*B41J 3/36* (2006.01)

(52) U.S. Cl. ..... 347/109; 400/88

(58) Field of Classification Search ..... 347/109; 400/88

See application file for complete search history.

(56) References Cited

U.S. PATENT DOCUMENTS 5,028,934 A 7/1991 Kasae et al.
5,443,320 A 8/1995 Agata et al.
5,816,718 A 10/1998 Poole
5,825,995 A 10/1998 Wiklof et al.
5,927,872 A 7/1999 Yamada
5,988,900 A 11/1999 Bobry
6,062,686 A 5/2000 Kinoshita et al.
6,092,941 A 7/2000 Imai
6,357,939 B1 3/2002 Baron (Continued)

FOREIGN PATENT DOCUMENTS

EP 036295 9/1981

(Continued)

OTHER PUBLICATIONS

Derwent Abstract Accession No. 84-270472/44, DE 3314041 A (NCR Corp) Oct. 25, 1984. See Abstract.

(Continued)

*Primary Examiner*—Stephen Meier
*Assistant Examiner*—Ly T. Tran

(57) ABSTRACT

A manually moveable printer (20) is designed to print onto a page of print media (20) as a user swipes (21) the printer across the page. The printer has a printhead arrangement, which includes a number of ink ejection nozzles. The printer has a speed sensor designed to measure the speed at which the printhead arrangement is moved relative to the print media and to generate speed data. The printer also has a print controller designed to receive image data from an image source, convert the image data into a number of drop ejection signals, receive the speed data from the speed sensor and operate the ink ejection nozzles. The nozzles are operated in accordance with the drop ejection control signals at a rate determined using the speed data.

5 Claims, 5 Drawing Sheets

U.S. PATENT DOCUMENTS

| | | | |
|---|---|---|---|
| 6,517,266 | B2 | 2/2003 | Saund |
| 2002/0030716 | A1 | 3/2002 | Watanabe et al. |
| 2002/0093570 | A1 | 7/2002 | Silverbrook |

FOREIGN PATENT DOCUMENTS

| | | | |
|---|---|---|---|
| JP | 09-118048 | | 5/1997 |
| JP | 2001-057586 | | 2/2001 |
| WO | WO 03068515 | A1 * | 8/2003 |

OTHER PUBLICATIONS

Derwent Abstract Accession No. 98-58036/06, JP 9300724 A (Brother Kogyo KK) Nov. 25, 1997. See Abstract.

* cited by examiner

MANUALLY MOVEABLE PRINTER WITH SPEED SENSOR

The present application is a 371 of PCT/AU03/00154 filed on Feb. 12, 2003.

FIELD OF THE INVENTION

This invention relates to improvements in printer technology, and, in particular, relates to a manually moveable printer with a speed sensor which is adapted to print onto a page of print media as a user swipes the printer across the page.

BACKGROUND

Prior art printers typically incorporate a supply of print media into the printer and employ a print media feed mechanism to transport the print media past the printhead(s) to effect printing onto the print media. In such printers it is essential during a printing operation to synchronise the speed of the print media with the printing rate of the printhead(s) to ensure a faithful reproduction of the image being printed. Up until now the synchronisation of the print media with the printhead(s) has been relatively simple to accomplish because the print media feed mechanism, including the supply of print media, has been an integral part of the printer. The speed of the print media is therefore known and controllable, as is the speed at which the printhead(s) and print controller operate, with synchronisation between these features being accomplished using simple mechanical features such as gears, stepper motors and the like.

However, the need to have a supply of print media accommodated within the printer has made these printers larger and heavier than they otherwise need be. Similarly, the need for a print media drive mechanism integral to the printer to ensure proper synchronisation between ink ejection and print media transport has limited the minimum possible printer size.

CO-PENDING APPLICATIONS

Various methods, systems and apparatus relating to the present invention are disclosed in the following co-pending applications filed by the applicant or assignee of the present invention simultaneously with the present application:

| | | |
|---|---|---|
| | PCT/AU03/00154 | PCT/AU03/00151 |
| PCT/AU03/00150 | PCT/AU03/00145 | PCT/AU03/00153 |
| PCT/AU03/00152 | PCT/AU03/00168 | PCT/AU03/00169 |
| PCT/AU03/00170 | | PCT/AU03/00162 |
| PCT/AU03/00146 | PCT/AU03/00159 | PCT/AU03/00171 |
| PCT/AU03/00149 | PCT/AU03/00167 | PCT/AU03/00158 |
| PCT/AU03/00147 | PCT/AU03/00166 | PCT/AU03/00164 |
| PCT/AU03/00163 | PCT/AU03/00165 | PCT/AU03/00160 |
| PCT/AU03/00157 | PCT/AU03/00148 | PCT/AU03/00156 |
| PCT/AU03/00155 | | |

The disclosures of these co-pending applications are incorporated herein by cross-reference.

RELATED PATENT APPLICATIONS AND PATENTS

| | | | |
|---|---|---|---|
| U.S. Pat. No. 6,227,652 | U.S. Pat. No. 6,213,588 | U.S. Pat. No. 6,213,589 | U.S. Pat. No. 6,231,163 |
| U.S. Pat. No. 6,247,795 | U.S. Pat. No. 6,394,581 | U.S. Pat. No. 6,244,691 | U.S. Pat. No. 6,257,704 |
| U.S. Pat. No. 6,416,168 | U.S. Pat. No. 6,220,694 | U.S. Pat. No. 6,257,705 | U.S. Pat. No. 6,247,794 |
| U.S. Pat. No. 6,234,610 | U.S. Pat. No. 6,247,793 | U.S. Pat. No. 6,264,306 | U.S. Pat. No. 6,241,342 |
| U.S. Pat. No. 6,247,792 | U.S. Pat. No. 6,264,307 | U.S. Pat. No. 6,254,220 | U.S. Pat. No. 6,234,611 |
| U.S. Pat. No. 6,302,528 | U.S. Pat. No. 6,283,582 | U.S. Pat. No. 6,239,821 | U.S. Pat. No. 6,338,547 |
| U.S. Pat. No. 6,247,796 | U.S. 09/113,122 | U.S. Pat. No. 6,390,603 | U.S. Pat. No. 6,362,843 |
| U.S. Pat. No. 6,293,653 | U.S. Pat. No. 6,312,107 | U.S. Pat. No. 6,227,653 | U.S. Pat. No. 6,234,609 |
| U.S. Pat. No. 6,238,040 | U.S. Pat. No. 6,188,415 | U.S. Pat. No. 6,227,654 | U.S. Pat. No. 6,209,989 |
| U.S. Pat. No. 6,247,791 | U.S. Pat. No. 6,336,710 | U.S. Pat. No. 6,217,153 | U.S. Pat. No. 6,416,167 |
| U.S. Pat. No. 6,243,113 | U.S. Pat. No. 6,283,581 | U.S. Pat. No. 6,247,790 | U.S. Pat. No. 6,260,953 |
| U.S. Pat. No. 6,267,469 | U.S. Pat. No. 6,273,544 | U.S. Pat. No. 6,309,048 | U.S. Pat. No. 6,420,196 |
| U.S. Pat. No. 6,443,558 | U.S. 09/422,892 | U.S. Pat. No. 6,378,989 | U.S. 09/425,420 |
| U.S. 09/422,893 | U.S. 09/609,140 | U.S. Pat. No. 6,409,323 | U.S. Pat. No. 6,281,912 |
| U.S. 09/575,113 | U.S. Pat. No. 6,318,920 | U.S. Pat. No. 6,488,422 | U.S. 09/693,644 |
| U.S. Pat. No. 6,457,810 | U.S. Pat. No. 6,485,135 | U.S. 09/112,763 | U.S. Pat. No. 6,331,946 |
| U.S. Pat. No. 6,246,970 | U.S. Pat. No. 6,442,525 | U.S. 09/505,951 | U.S. 09/505,147 |
| U.S. 09/505,952 | U.S. 09/575,108 | U.S. 09/575,109 | U.S. 09/575,110 |
| U.S. 09/607,985 | U.S. Pat. No. 6,398,332 | U.S. Pat. No. 6,394,573 | U.S. 09/606,999 |
| U.S. Pat. No. 6,238,044 | U.S. Pat. No. 6,425,661 | U.S. Pat. No. 6,390,605 | U.S. Pat. No. 6,322,195 |
| U.S. 09/504,221 | U.S. Pat. No. 6,480,089 | U.S. Pat. No. 6,460,778 | U.S. Pat. No. 6,305,788 |
| U.S. Pat. No. 6,426,014 | U.S. Pat. No. 6,364,453 | U.S. Pat. No. 6,457,795 | U.S. 09/556,219 |
| U.S. 09/556,218 | U.S. Pat. No. 6,315,399 | U.S. Pat. No. 6,338,548 | U.S. 09/575,190 |
| U.S. Pat. No. 6,328,431 | U.S. Pat. No. 6,328,425 | U.S. 09/575,127 | U.S. Pat. No. 6,383,833 |
| U.S. Pat. No. 6,464,332 | U.S. Pat. No. 6,390,591 | U.S. 09/575,152 | U.S. Pat. No. 6,328,417 |
| U.S. Pat. No. 6,322,194 | U.S. 09/575,177 | U.S. 09/575,175 | U.S. Pat. No. 6,417,757 |
| U.S. 09/608,780 | U.S. Pat. No. 6,428,139 | U.S. 09/607,498 | U.S. 09/693,079 |
| U.S. 09/693,135 | U.S. Pat. No. 6,428,142 | U.S. 09/692,813 | U.S. 09/693,319 |
| U.S. 09/693,311 | U.S. Pat. No. 6,439,908 | U.S. 09/693,735 | PCT/AU98/00550 |
| PCT/AU00/00516 | PCT/AU00/00517 | PCT/AU00/00511 | PCT/AU00/00754 |
| PCT/AU00/00755 | PCT/AU00/00756 | PCT/AU00/00757 | PCT/AU00/00095 |
| PCT/AU00/00172 | PCT/AU00/00338 | PCT/AU00/00339 | PCT/AU00/00340 |
| PCT/AU00/00341 | PCT/AU00/00581 | PCT/AU00/00580 | PCT/AU00/00582 |
| PCT/AU00/00587 | PCT/AU00/00588 | PCT/AU00/00589 | PCT/AU00/00583 |
| PCT/AU00/00593 | PCT/AU00/00590 | PCT/AU00/00591 | PCT/AU00/00592 |
| PCT/AU00/00584 | PCT/AU00/00585 | PCT/AU00/00586 | PCT/AU00/00749 |

-continued

| | | | |
|---|---|---|---|
| PCT/AU00/00750 | PCT/AU00/00751 | PCT/AU00/00752 | PCT/AU01/01332 |
| PCT/AU01/01318 | PCT/AU00/01513 | PCT/AU00/01514 | PCT/AU00/01515 |
| PCT/AU00/01516 | PCT/AU00/01517 | PCT/AU00/01512 | PCT/AU01/00502 |
| PCT/AU02/01120 | PCT/AU00/00333 | PCT/AU01/00141 | PCT/AU01/00139 |
| PCT/AU01/00140 | PCT/AU00/00753 | PCT/AU01/01321 | PCT/AU01/01322 |
| PCT/AU01/01323 | PCT/AU00/00594 | PCT/AU00/00595 | PCT/AU00/00596 |
| PCT/AU00/00597 | PCT/AU00/00598 | PCT/AU00/00741 | PCT/AU00/00742 |

SUMMARY OF THE INVENTION

According to a first aspect of the present invention there is disclosed a printer adapted to be moveable by a user relative to print media and comprising:

a printhead arrangement adapted to effect printing Onto the print media as the printer is moved relative to the print media, the printhead arrangement including a plurality of ink ejection nozzles;

an ink supply adapted to store ink and to supply the ink to the printhead arrangement;

a speed sensor adapted to measure the speed at which the printhead arrangement is moved relative to the print media and to generate speed data; and a print controller adapted to:

(a) receive image data from an image source;

(b) convert the image data into a plurality of drop ejection control signals;

(c) receive the speed data from the speed sensor, and (d) operate the ink ejection nozzles in the printhead arrangement in accordance with the drop ejection control signals at a rate determined using the speed data, to thereby effect printing of the image data onto the print media;

a capping arrangement moveable between a capped position in which the capping arrangement obstructs the ejection of ink from the ink ejection nozzles and an un-capped position in which the capping arrangement does not substantially obstruct the ejection of ink from the ink ejection nozzles, the capping arrangement comprising a mounting portion pivotally mounted on the printer and a capping arm extending substantially perpendicularly from the mounting portion to a distal end, the distal end lying adjacent the ink ejection nozzles to obstruct ink ejection from the ink ejection nozzles when the capping arrangement is mounted on the printer and is in the capped position; and a capping actuator disposed on the printer so as to be operable by a user as the user moves the printhead arrangement relative to the print media.

BRIEF DESCRIPTION OF THE DRAWING

The invention will now be described by way of example only with reference to preferred embodiments and to the accompanying drawings in which.

DETAILED DESCRIPTION OF PREFERRED AND OTHER EMBODIMENTS

Figure 1:
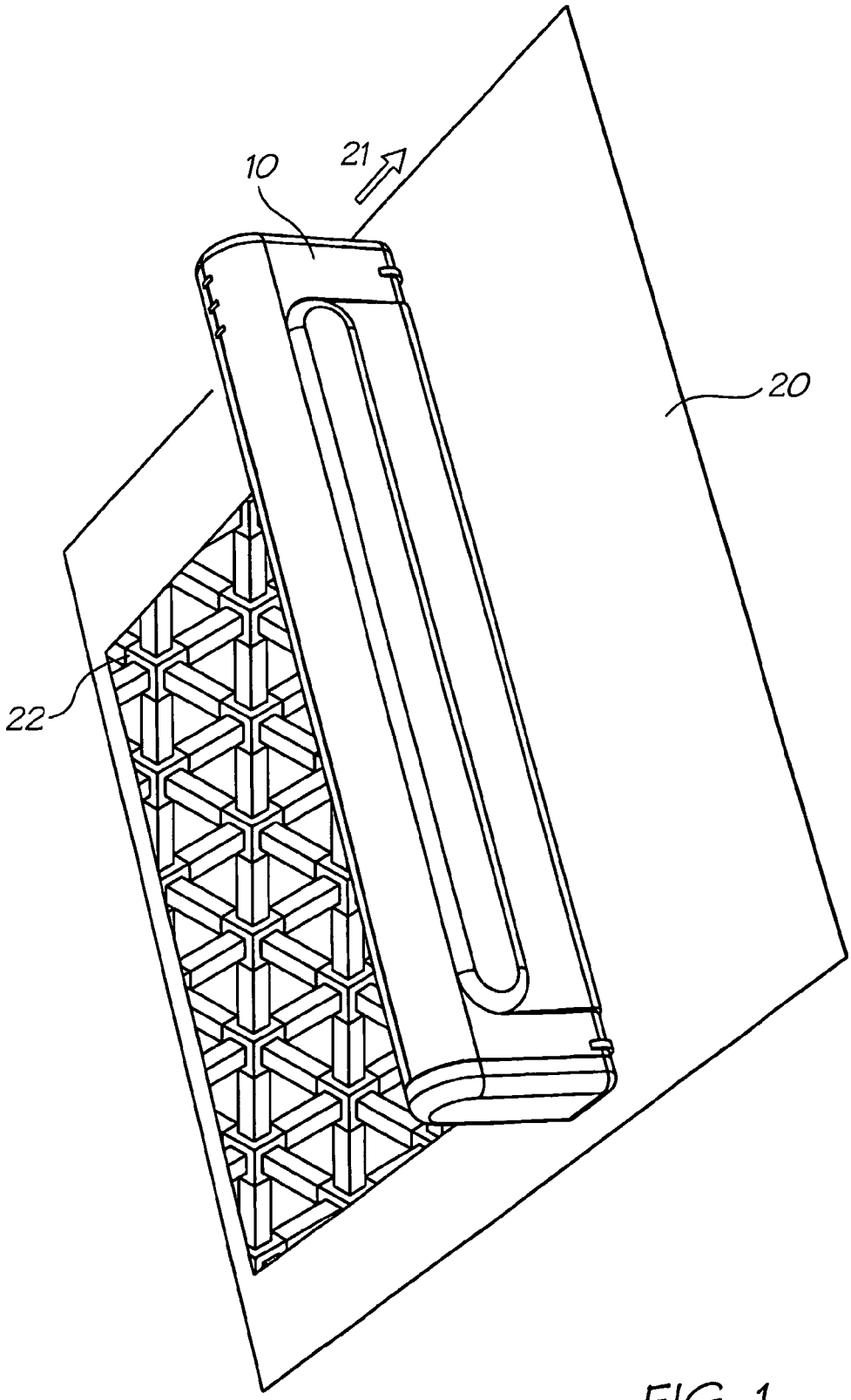
FIG. 1 is a perspective view of a preferred embodiment of a printer according to the invention, in use.

As shown in FIG. 1, a printer 10 according to a preferred embodiment of the invention prints an image 22 on the page 20 as it traverses the page in the direction of the arrow 21 under the guidance of a user (not shown).

Figure 2:
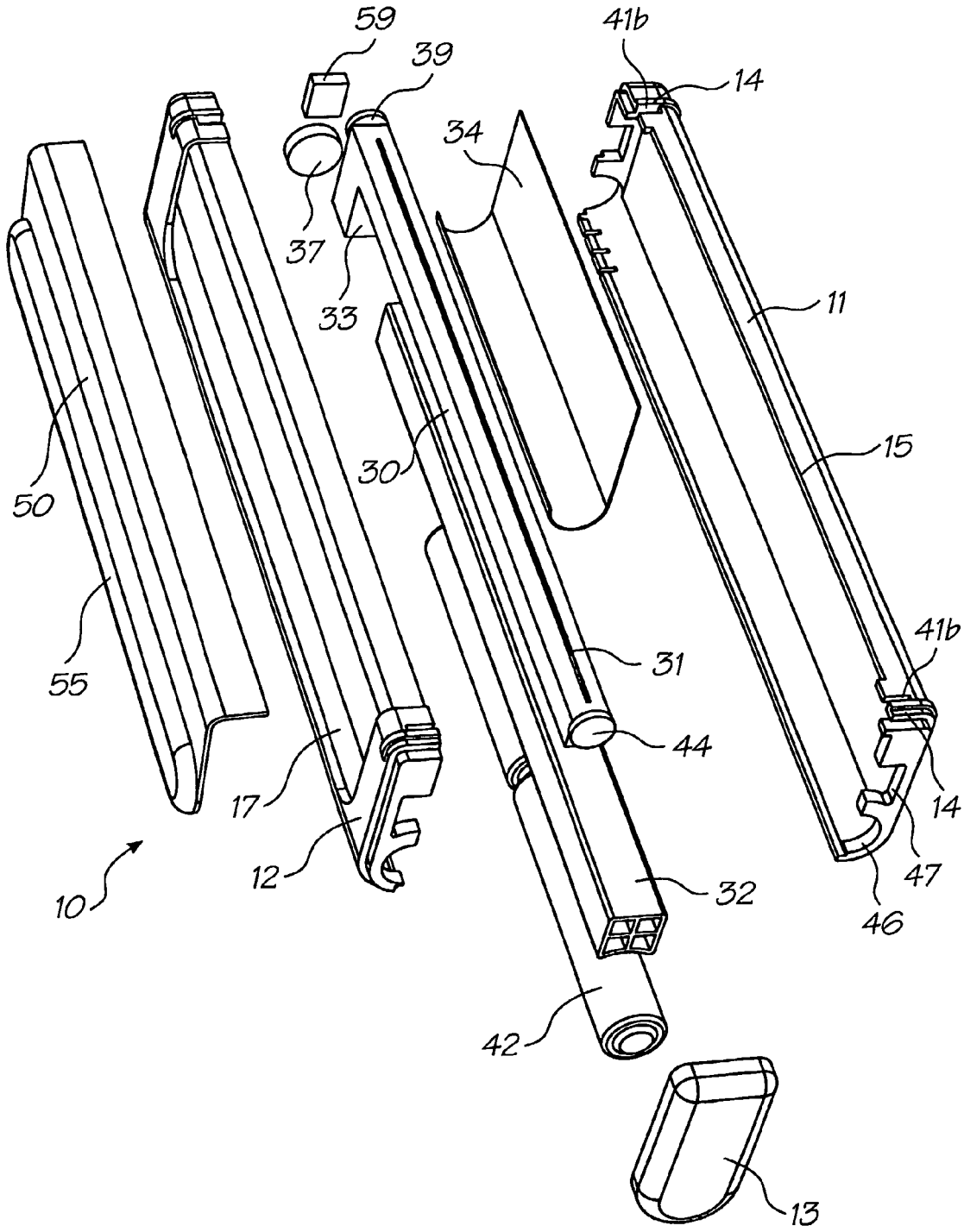
FIG. 2 is an exploded perspective view of the printer.

An exploded perspective view of the printer 10 of FIG. 1 is shown in FIG. 2. As seen in FIG. 2, the printer 10 includes a lower moulding 11, an upper moulding 12 and a removable end cap 13 each of which may be formed of any suitable plastics, metal or similar material.

The upper and lower mouldings each include media slides 14 formed on the bottom surface of each end of the mouldings. The slides 14 protrude from the bottom surface of the mouldings and serve to elevate the printer as the printer traverses the print media, resulting in minimal friction between the printhead and the print media. The slides also serve to prevent contact between the printer and freshly printed ink which could otherwise disturb the printed image.

When joined, the upper and lower mouldings reveal an ink ejection slot 15 through which ink is ejected during printing. A capping device 50, preferably of metal, is received in a recess 17 formed in the upper moulding 12. The capping device 50, pivots about a pivot point (described below) from a capped position in which a capping arm 52 of the capping device 50 blocks the ink ejection slot 15, to an un-capped position in which the ink ejection is unrestricted. Operation of the capping device 50 is effected using a finger pad 55 formed integrally with the capping device.

Internally, the printer 10 includes a printhead module 30 in which is disposed a plurality of ink distribution channels leading to an array of ink ejection nozzles 31 aligned with the ink ejection slot 15 formed between the upper and lower mouldings. An ink supply cartridge 32 stores ink, preferably in four colors, namely cyan, magenta, yellow and black, to provide for full color printing. Alternatively, or in addition, infra-red ink may be provided. The ink cartridge 32 supplies ink to the ink distribution channels of the printhead module 30 through an ink connector 33.

Any one of a number of known printhead modules and ink supply systems may be suitable for use with the present invention and thus further description of such features is omitted here. Details of printhead modules and ink supply systems suitable for use with the invention can be found in the co-pending applications listed at the start of this specification.

A print controller 36 includes a microprocessor that converts image data stored in microprocessor memory into a sequence of electrical "drop ejection" signals. The signals are communicated to the printhead module 30 in a known manner during a print operation to cause selective ejection of ink from the ink ejection nozzles 31.

The print control microprocessor 36 (not shown) communicates with external devices to receive print instructions, in particular digital image data. In the embodiment shown, digital image data may be provided to the microprocessor 36 as an infra-red (IR) signal through an IR window 59 formed in one end panel of the printer 10. An IR receiver electrically connected to the microprocessor 36 receives the data which is then stored in the processor memory. In alternative embodiments, the microprocessor may communicate through any other suitable connection such as hard wire connections to other electronic devices (such as computers, scanners, copiers, digital cameras and the like), wireless telecommunications (such as WAP and the like) or through a plug and socket connection or data port. Other information, for example print control instructions, may also be provided to the printer from external devices using the above systems. In a further embodiment, the microprocessor may have its own graphics generating capabilities.

The upper and lower mouldings provide a recess in which to receive batteries 42, for example two 1.5 V "AAA" batteries. A flexible printed circuit board (PCB) 34 has busbars (not shown) thereon that convey power from the batteries 42 to the printhead module 30, microprocessor 36 and any other powered components.

A power switch 43 formed in an end panel of the printer 10 is operated by a user to actuate the printer between powered and unpowered modes.

Figure 3:
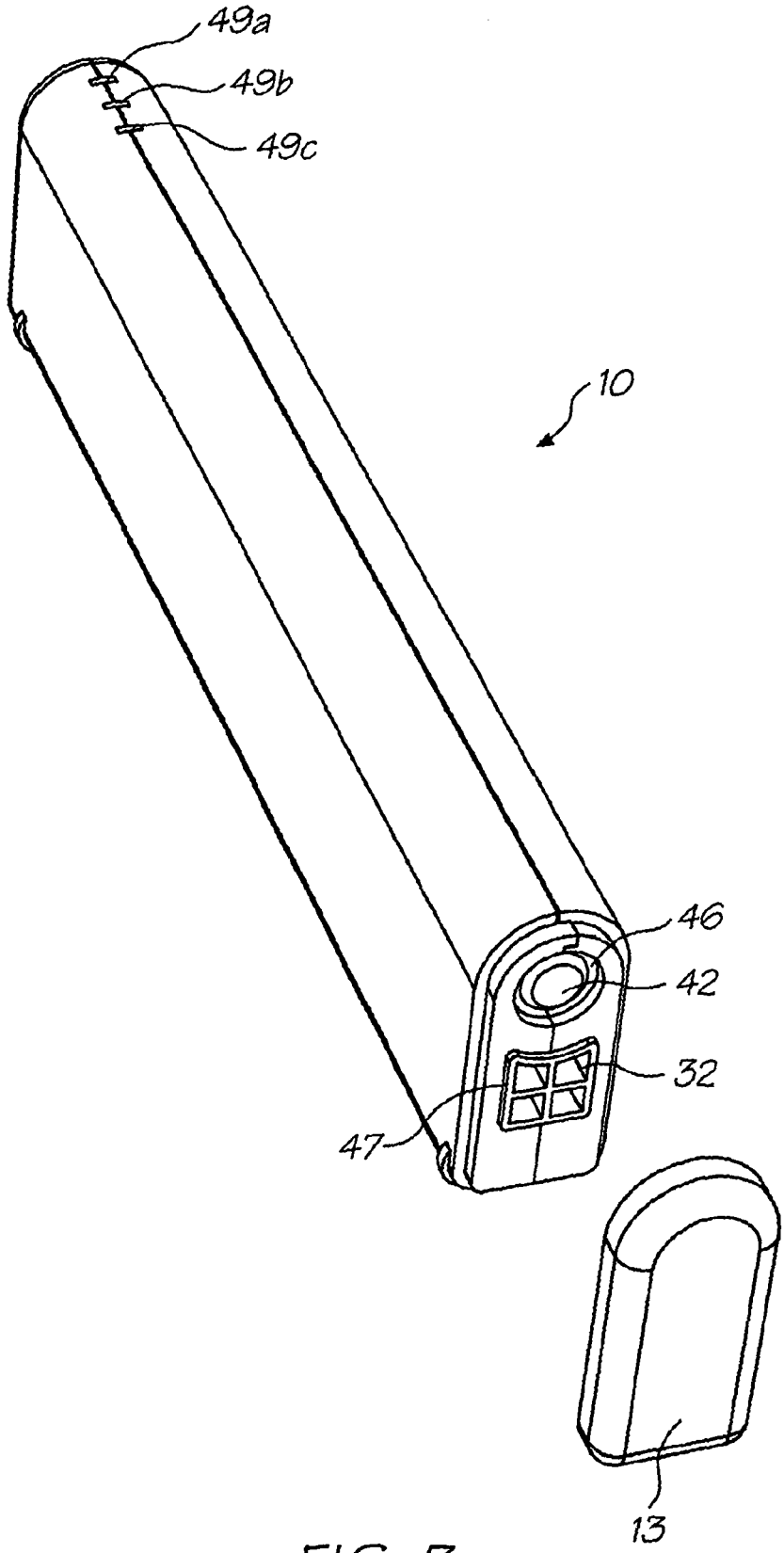
FIG. 3 is a perspective end view of the printer.

The batteries 42 are removable from the printer 10 through an aperture 46 formed between the upper and lower mouldings. The ink cartridge may be removed and replaced through a similar aperture 47. As illustrated in FIG. 3, the end cap 13 is first removed from the printer 10 to reveal the apertures 46, 47 after which the batteries and/or ink cartridge may be replaced. In a further embodiment not illustrated here, the batteries and ink cartridge may be provided as an integral unit within a removable housing with only one aperture being formed in the end of the printer 10 to receive the housing.

A plurality of status indicating light emitting diodes (LEDs) 49*a*, 49*b*, 49*c* (FIG. 3) are electrically connected to the microprocessor and are disposed in an outer surface of the printer 10. The separate LEDs can be used for indicating error conditions such as low battery, low ink or general printer operation error conditions as well as a general printer ON/OFF condition.

Figure 4:
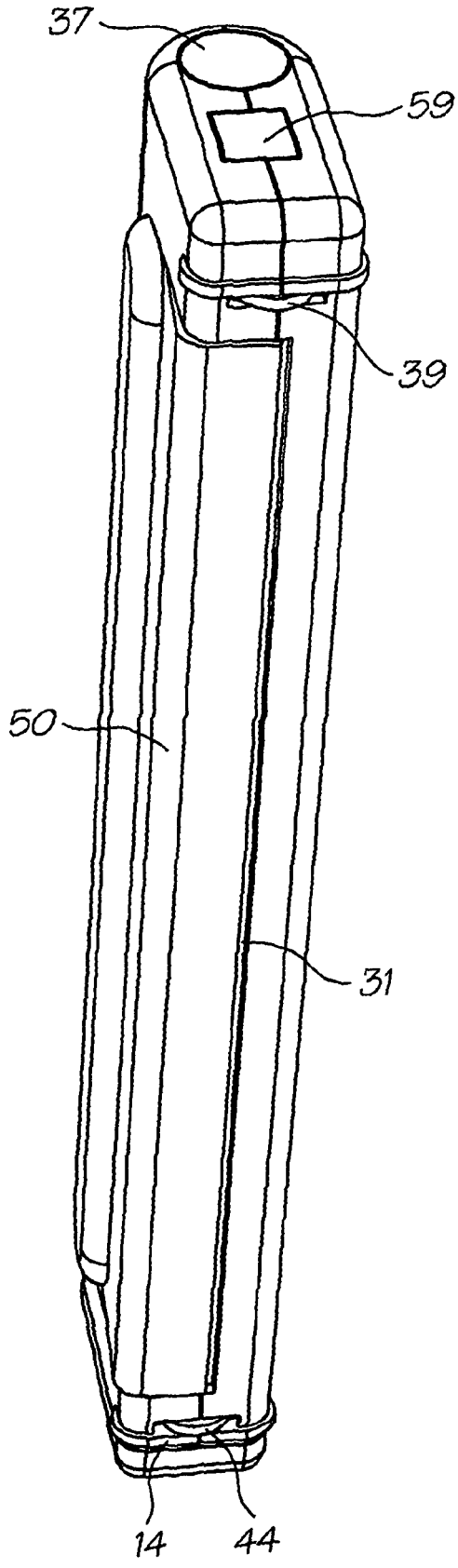
FIG. 4 is a perspective bottom view of the printer.

To perform printing, a user first actuates the capping device 50, in a manner described below, to expose the printhead chip 31 (FIG. 4) to the print media. The print media may be any suitable textile for receiving the type of ink stored in the printer and may include inter alia paper, cardboard, wood, fabric and plastics. The printer 10 may include further control buttons designed to be depressed by the user to initiate printing, i.e. to commence the ejection of ink from the printhead under the control of the print control microprocessor. Alternatively, actuation of the capping device 50 may be detected as a signal that the user is ready for the printing to commence. The user then moves the printer 10 across the print media 20 as illustrated in FIG. 1.

To control the printing rate, the printer 10 includes an optical encoder wheel 39 (FIG. 2) attached to the printhead module 30 at one end thereof. The optical encoder wheel 39 is received in slots 41*a*, 41*b* formed in the upper and lower mouldings respectively and extends from the mouldings to the point where the rim of the wheel 39 is level with the media slides 14 (see FIG. 4). Circumferentially spaced markings on the optical encoder wheel 39 are read by an optical sensor on the microprocessor 36 as the wheel 39 rotates.

The optical sensor includes a light source, such as an LED, and a photo-detector that produces an electrical response dependant upon the amount of light incident upon the detector. The light reflection characteristics of the encoder wheel 39 vary between the marked and un-marked areas and thus, as the markings rotate past the detector, a change in the detector response occurs. The frequency at which the detector response changes provides a measurement of the speed at which the encoder wheel is rotating, and therefore the speed at which the printer is moving relative to the print media. The detector response is communicated to the print control microprocessor 36 which uses the signal to calculate the speed at which the printhead module is being moved across the print media. The print controller then synchronises the rate at which the drop ejection control signals are passed to the ink ejection nozzles with the measured speed at which the printer is moving. The printer 10 is therefore able to ensure appropriate print dot spacing of successive lines of print and thus create a faithful reproduction of the printed image even though the printer does not control the speed at which the print media moves relative to the printhead.

Furthermore, if the number of markings on the encoder wheel 39 is high enough, the microprocessor 36 is able to quickly adapt to the variations in the speed at which a user may move the printer across the print media thereby achieving a higher quality image. In one embodiment, the markings on the encoder wheel are spaced in such a way that the circumferential spacing between successive markings on the wheel is substantially equal to the spacing between successive print lines in the image being printed. In this embodiment, the detection of a marking on the wheel triggers the printing of the next line of the image.

An idler wheel 44 is attached to the opposite end of the printhead module 30 to allow stability and directional control of the printer. A shaft may connect the idler wheel 44 with the encoder wheel 39 to synchronise the rotation speeds of each wheel.

The optical encoder wheel 39 or idler wheel 44 may have a speed limiter such as a friction clutch that prevents a user from moving the printer along the print media at a rate faster than the maximum rate of operation of the printhead module 30. Furthermore, either or both wheels may have a system such as a ratchet for preventing the printer from being moved in the opposite direction to the direction of printing.

Figure 5:
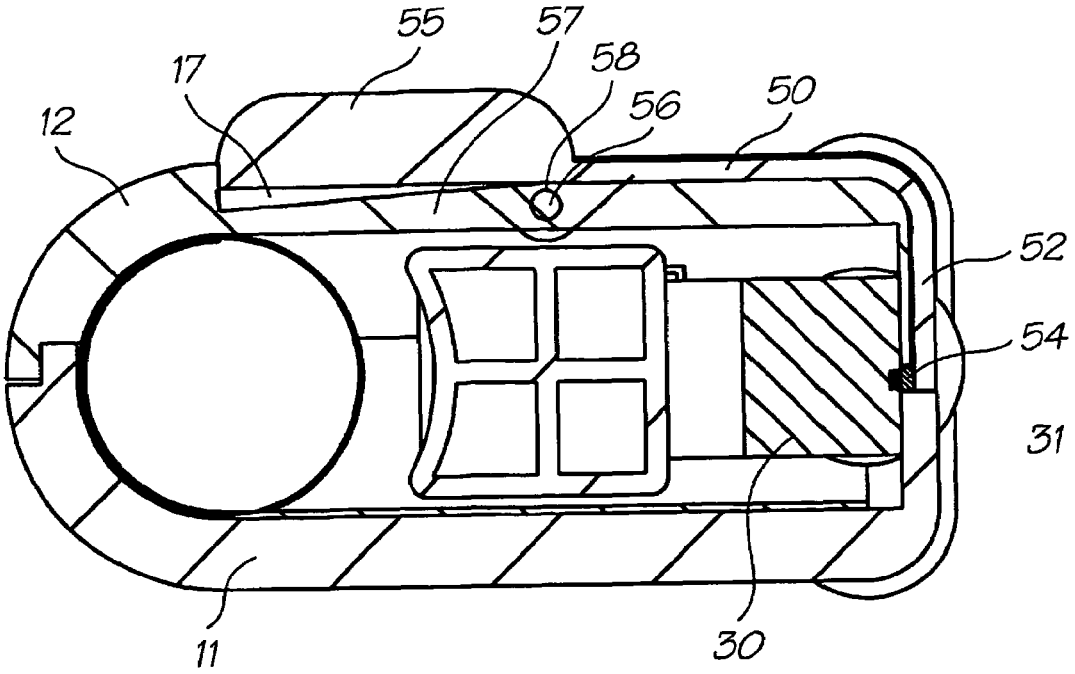
FIG. 5 is a cross section of the printer illustrating a capping device in a capped position.
Figure 6:
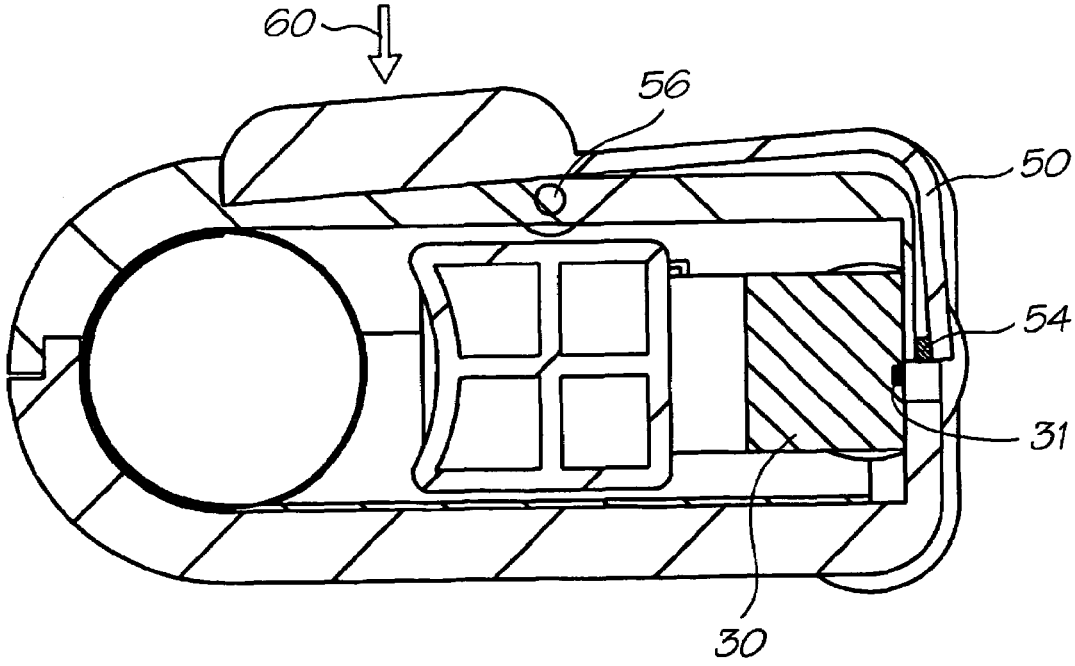
FIG. 6 is a cross section of the printer illustrating the capping device in an un-capped position.

Operation of the capping device 50 will now be described with reference to FIGS. 5 and 6. Referring first to FIG. 5 there is shown an end cross-section of the printer unit 10. The capping device 50 is disposed in a recess 17 of the upper moulding 12. The capping device 50 is a substantially L-shaped section having a mounting portion 51 received in the recess 17 and a capping arm 52 extending perpendicularly from the mounting portion. A finger pad 55 is formed along the length of the mounting portion 51.

At each end of the mounting portion 51 and on the opposite side to the finger pad 55 there extends a flange 57 having an aperture 58 therein. The aperture 58 engages a pivot 56 extending from an edge of the recess 17 to thereby mount the capping device 50 to the upper moulding 12 and at the same time allowing pivotal motion of the capping device.

When the capping device 50 is mounted to the upper moulding 12 as illustrated in FIG. 5, the capping arm 52 reaches to the printhead module 30 containing the ink ejection nozzles 31. An elastomeric pad 54 is formed on the distal end of the capping arm 52 for protecting the ink ejection nozzles. In the position shown in FIG. 5 the elastomeric pad 52 obstructs the ejection of ink from the printhead 30. Referring to FIG. 6, a user applies finger pressure to the finger pad 55 in the direction of the arrow 60 causing the capping device 50 to rotate about the pivot 56. As the capping device rotates, the capping arm moves away from the printhead 30 to a position where it no longer obstructs the ink ejection nozzles 31 and ink may successfully be ejected onto underlying print media.

The capping device 50 may further include a spring biasing the capping device 50 to the capped position when finger pressure is removed from the finger pad 55.

A contact sensor (not shown) may detect when the capping device 50 is moved to the uncapped position and communicate the state of the capping device to the print control microprocessor 36 so that printing is only attempted when the capping device 50 is in the uncapped position.

The printer 10 of the present invention may include keys for controlling the microprocessor to perform such printer operations as downloading image data from an external device, resetting an incomplete print operation so that the printer commences printing at the start of an image etc. Alternatively, these functions may be communicated to the printer through the IR data port described previously.

The invention claimed is:

1. A printer adapted to be moveable by a user relative to print media and comprising:

a printhead arrangement adapted to effect printing onto the print media as the printer is moved relative to the print media, the printhead arrangement including a plurality of ink ejection nozzles;

an ink supply adapted to store ink and to supply the ink to the printhead arrangement;

a speed sensor adapted to measure the speed at which the printhead arrangement is moved relative to the print media and to generate speed data;

a print controller adapted to:

(a) receive image data from an image source;

(b) convert the image data into a plurality of drop ejection control signals;

(c) receive the speed data from the speed sensor; and (d) operate the ink ejection nozzles in the printhead arrangement in accordance with the drop ejection control signals at a rate determined using the speed data, to thereby effect printing of the image data onto the print media;

a capping arrangement moveable between a capped position in which the capping arrangement obstructs the ejection of ink from the ink ejection nozzles and an un-capped position in which the capping arrangement does not substantially obstruct the ejection of ink from the ink ejection nozzles, the capping arrangement comprising a mounting portion pivotally mounted on the printer and a capping arm extending substantially perpendicularly from the mounting portion to a distal end, the distal end lying adjacent the ink ejection nozzles to obstruct ink ejection from the ink ejection nozzles when the capping arrangement is mounted on the printer and is in the capped position; and a capping actuator disposed on the printer so as to be operable by a user as the user moves the printhead arrangement relative to the print media.

2. The printer of claim 1 further comprising a finger pad formed on the mounting portion of the capping arrangement.

3. The printer of claim 1 wherein the speed sensor comprises:

an optical encoder wheel adapted to be in contact with the print media and to rotate as the printer is moved relative to the print media, the optical encoder wheel having a series of circumferentially spaced markings thereon, wherein the circumferential spacing between successive markings on the optical encoder wheel is substantially equal to the spacing between successive print lines in the image data being printed; and an optical sensor adapted to:

(a) detect the markings as the markings pass the optical sensor during rotation of the optical encoder wheel; and (b) generate the speed data from the detected markings.

4. The printer of claim 1 further comprising a housing for receiving one or more batteries and an ink supply, the housing being removable from the printer to simultaneously remove the one or more batteries and the ink supply.

5. The printer of claim 3 wherein the detection of a marking on the encoder wheel triggers the printing of a next line of the image data.

* * * * *